US006421637B1

(12) United States Patent
Suda

(10) Patent No.: US 6,421,637 B1
(45) Date of Patent: Jul. 16, 2002

(54) PITCH SHIFTING APPARATUS AND METHOD

(75) Inventor: Masayuki Suda, Hamamatsu (JP)

(73) Assignee: Kabushiki Kaisha Kawai Gakki Seisakusho, Shizuoka-ken (JP)

( * ) Notice: Subject to any disclaimer, the term of this patent is extended or adjusted under 35 U.S.C. 154(b) by 0 days.

(21) Appl. No.: 09/420,907

(22) Filed: Oct. 20, 1999

(30) Foreign Application Priority Data

Oct. 21, 1998 (JP) ..... 10-300157

(51) Int. Cl.[7] ..... G10L 11/04

(52) U.S. Cl. ..... 704/207; 704/205

(58) Field of Search ..... 704/205, 207, 704/268, 269, 209

(56) References Cited

U.S. PATENT DOCUMENTS 4,464,784 A * 8/1984 Agnello ..... 381/61
4,586,191 A * 4/1986 Nishimura ..... 704/258
4,627,090 A * 12/1986 Smith, III et al. ..... 704/205
4,700,391 A * 10/1987 Leslie, Jr. et al. ..... 704/207
5,131,042 A * 7/1992 Oda ..... 704/503

* cited by examiner

*Primary Examiner*—Marsha D. Banks-Harold
*Assistant Examiner*—Daniel Abebe
(74) *Attorney, Agent, or Firm*—Bachman & LaPointe, P.C.

(57) ABSTRACT

In a pitch shifting method, an input sound signal is stored into a memory, and a period of the input sound signal is extracted. Then, a sawtooth wave is produced whose amplitude is set to a value which is integer times the extracted period. A read address is designated based on the sawtooth wave, and the input sound signal is read from the memory using the designated read address.

4 Claims, 3 Drawing Sheets

PITCH SHIFTING APPARATUS AND METHOD

BACKGROUND OF THE INVENTION

1. Field of the Invention

The present invention relates to a technique for shifting a frequency (pitch) of an input sound signal by a given value and outputting the frequency-shifted sound signal in real time.

2. Description of the Related Art

Pitch shifting apparatuses have been used in karaoke (recorded orchestral accompaniment) apparatuses or the like for shifting a frequency (pitch) of an input sound such as an instrument sound or voice by a given value and outputting the frequency-shifted sound in real time. The pitch shifting apparatus converts an analog signal indicative of an input sound into a digital signal, writes the digital signal into a memory in sequence at a constant write speed, while reads the signal from the memory at a speed different from the write speed. then decodes the read-out signal for reproduction, so that a sound having a pitch different from that of the input sound is outputted.

For reading the signal from the memory, a sawtooth wave is used. Specifically, the signal is read by using a sawtooth wave as a reading waveform to designate read addresses. However, the signal thus read includes discontinuous points in many cases. For eliminating the discontinuous points, various measures have been taken.

For example, two sawtooth waves having a phase difference of 180° from each other are used to designate read addresses thereby to read pitch-shifted signals from a memory. Then, with respect to the two signals thus read from the memory, two triangular waves synchronous with the sawtooth waves, respectively, are used to carry out amplitude modulation to cause levels at discontinuous points of the signals to be zero. Finally, the signals are added to each other to derive a pitch-shifted signal having no discontinuous points.

In the foregoing technique, however, since phases of the signals read from the memory do not always coincide with each other, the amplitude of the sum signal does not become constant. This adversely affects the tone quality as if amplitude modulation were effected.

In view of this, Japanese Laid-open (unexamined) Patent Publication No. 7-306693 proposes an improved technique, wherein read addresses are designated so that the two signals read from the memory have a section corresponding to a period of the foregoing triangular signals where the signals continuously have the mutually same values. Even in this technique, however, the foregoing adverse affect to the tone quality can not be fully eliminated.

Further, the foregoing conventional techniques both require two or more signal processing systems so that complicated circuit structures are resulted.

SUMMARY OF THE INVENTION

Therefore, it is an object of the present invention to provide a pitch shifting technique which is capable of producing a pitch-shifted sound free of the foregoing adverse affect to the tone quality with a simple structure.

According to one aspect of the present invention, there is provided a pitch shifting apparatus comprising a memory for storing an input sound signal; a period extracting means for extracting a period of the input sound signal; and an address designating means for producing a sawtooth wave having an amplitude set to a value which is integer times the extracted period and for designating a read address based on the sawtooth wave, wherein the input sound signal is read from the memory using the read address designated by the address designating means.

It may be arranged that the period extracting means counts one wavelength of the input sound signal with a sampling period to derive a counted value corresponding to the period of the input sound signal, and the address designating means sets the amplitude of the sawtooth wave to a value which is integer times the counted value.

According to another aspect of the present invention, there is provided a pitch shifting method comprising the steps of storing an input sound signal; extracting a period of the input sound signal;

producing a sawtooth wave having an amplitude set to a value which is integer times the extracted period; designating a read address based on the sawtooth wave; and reading the input sound signal from the memory using the read address.

It may be arranged that the step of extracting the period of the input sound signal comprises counting one wavelength of the input sound signal with a sampling period to derive a counted value corresponding to the period of the input sound signal, and the step of producing the sawtooth wave comprises setting the amplitude of the sawtooth wave to a value which is integer times the counted value.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, a preferred embodiment of the present invention will be described hereinbelow with reference to the accompanying drawings.

Figure 1:
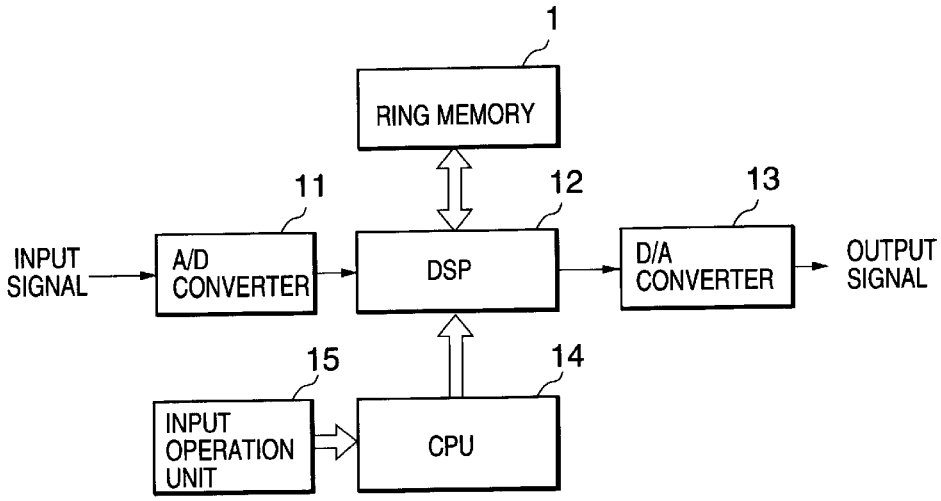
FIG. 1 is a block diagram showing a hardware configuration of a karaoke apparatus including a pitch shifting apparatus according to a preferred embodiment of the present invention.

FIG. 1 shows a hardware configuration of a karaoke apparatus including a pitch shifting apparatus according to the preferred embodiment of the present invention. An input sound signal received from the exterior via a microphone or the like is digitized at an A/D converter 11 using a predetermined sampling frequency and then inputted into a DSP (digital signal processor) 12. According to an operation mode and parameters inputted via an input operation unit 15, a CPU 14 transfers an algorithm and various coefficients to the DSP 12. According to the algorithm and parameters sent from the CPU 14, the DSP 12 processes the sound signal received via the A/D converter 11. The sound signal processed at the DSP 12 is converted into an analog signal at a D/A converter 13, then amplified via an amplifier and finally outputted via a loudspeaker as a sound. During the processing at the DSP 12, a ring memory 1 is used for a pitch shifting process. The ring memory 1 is in the form of a RAM and is annularly accessed by the DSP 12. Various values set during the processing at the DSP 12 are stored in a RAM not shown.

Figure 2:
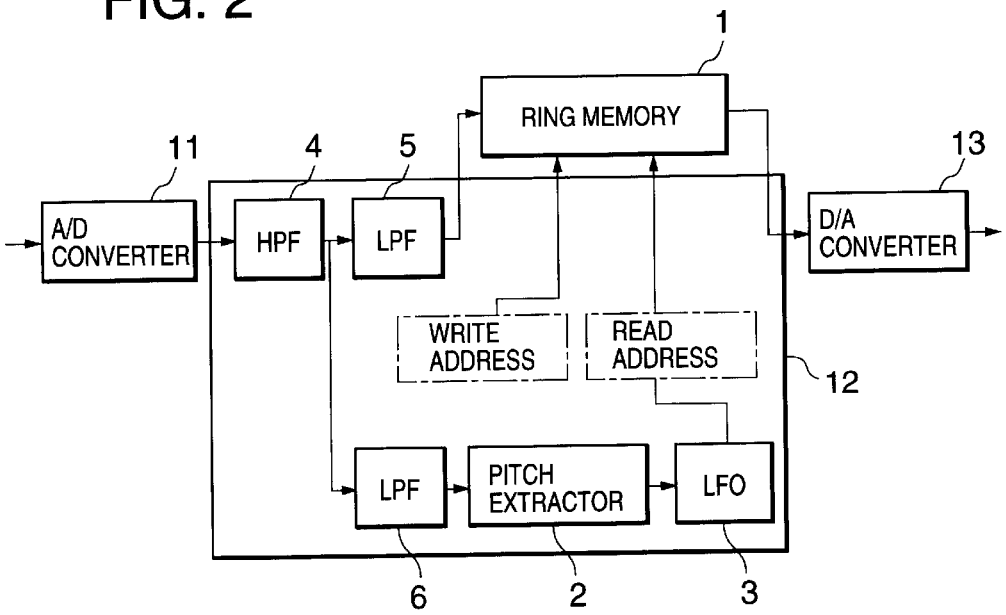
FIG. 2 is a block diagram showing functions implemented at a DSP of the pitch shifting apparatus shown in FIG. 1.

FIG. 2 is a block diagram showing functions implemented at the DSP 12 which constitutes the pitch shifting apparatus cooperatively with the ring memory 1.

An operation of the pitch shifting apparatus will be described hereinbelow.

At the DSP 12, an HPF (high-pass filter) 4 removes given low frequency components (noise) from the input sound signal digitized at the A/D converter 11. Then, an LPF (low-pass filter) 5 removes given high frequency components (noise) from the input sound signal received from the HPF 4. The input sound signal from the LPF 5 is assigned a write address and written into the ring memory 1 per sampling period.

On the other hand, the input sound signal from the HPF 4 is inputted into an LPF 6 where a wide range of high frequency components are removed. Then, a pitch extractor 2 serving as a period extracting means implements pitch extraction by detecting peak components of the input sound signal from the LPF 6. In practice, the pitch extraction is implemented by counting one wavelength of the input sound signal with a sampling period so as to derive a period of the input sound signal in a known manner. Then, an LFO (low frequency oscillator) 3 serving as an address designating means produces a sawtooth wave based on the derived signal period so as to designate read addresses. Specifically, an amplitude of the sawtooth wave is set to a value which is integer times a counted value corresponding to one wavelength of the input sound signal (in this embodiment, the amplitude of the sawtooth wave is set to the counted value corresponding to one wavelength of the input sound signal), and read addresses are designated using such a sawtooth wave. The DSP 12 reads the input sound signal stored in the ring memory 1 based on the designated read addresses and outputs a readout sound signal to the D/A converter 13.

Figure 3:
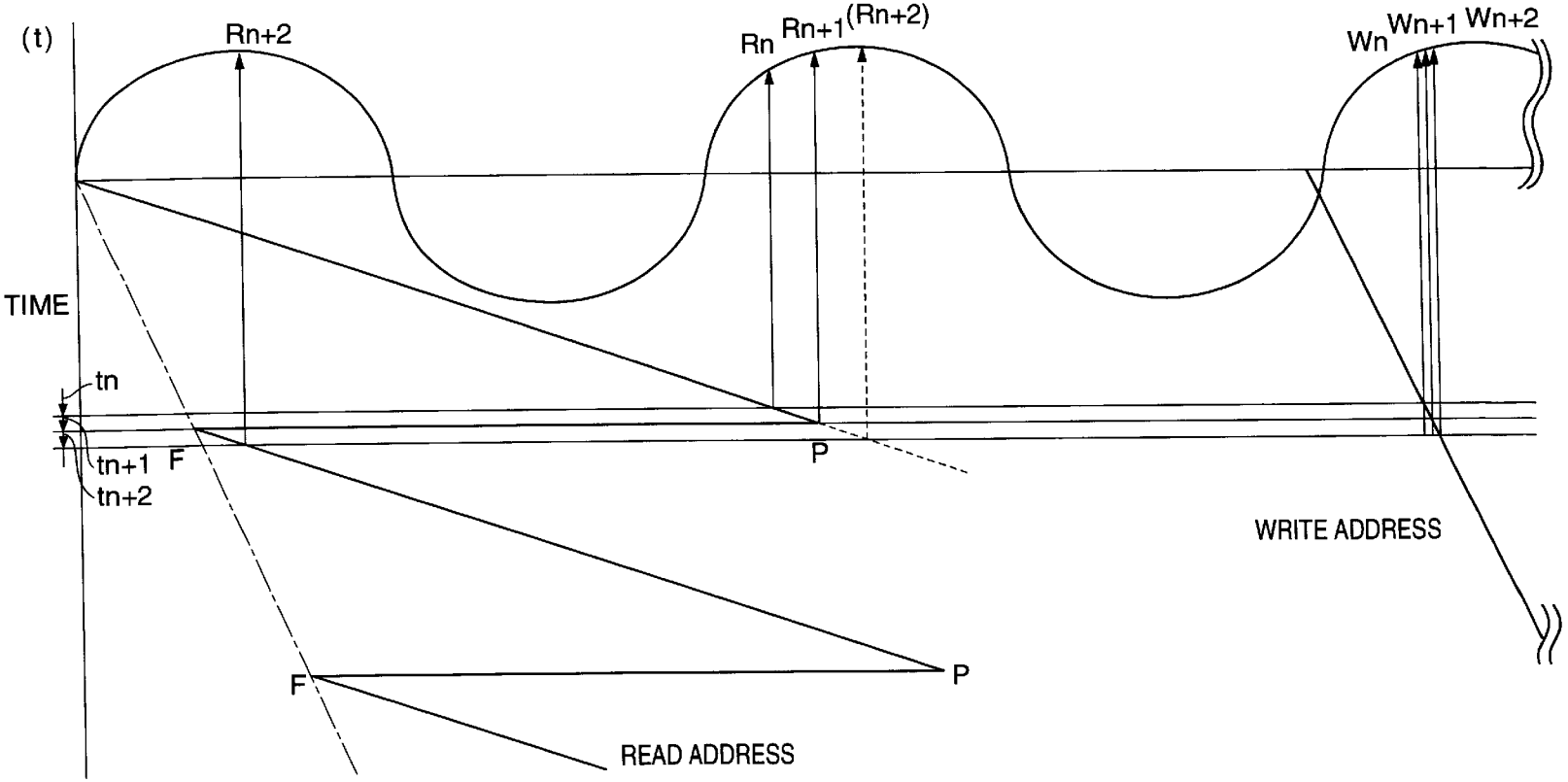
FIG. 3 is a time chart showing a relationship between reading of an input sound signal stored in a ring memory and a sawtooth wave when read addresses are designated according to the preferred embodiment of the present invention.

FIG. 3 is a time chart showing a relationship between reading of data of the input sound signal from the ring memory 1 and the sawtooth wave when read addresses are designated in the foregoing manner. In FIG. 3, an upper part shows the input sound signal stored in the ring memory 1, while a lower part shows a reading waveform in the form of the sawtooth wave for designating read addresses. In the figure, the ordinate represents a lapse of time, while the abscissa represents read addresses and write addresses. As shown by a thick solid line on a right side in the figure. the input sound signal is written into the ring memory 1 by designating write addresses (W) in a normal incrementing manner. Assuming that read addresses (R) are also designated in a normal incrementing manner like the write addresses, such read address designation is carried out as shown by a broken line on a left side in the figure. However, in this embodiment, read addresses (R) are designated based on the sawtooth wave, more specifically, read addresses are designated using a reading waveform obtained by adding the sawtooth wave to the foregoing broken line. Further, in this embodiment, the LFO 3 produces the sawtooth wave by setting an amplitude (from a peak P to a return point F) of the sawtooth wave to a value corresponding to one period of the input sound signal derived at the pitch extractor 2. In practice, as described above, the amplitude of the sawtooth wave is set to the counted value corresponding to one wavelength of the input sound signal. As appreciated, a pitch control of the input sound signal is executed by adjusting a slope of the sawtooth wave from the return point F to the peak P.

Figure 4:
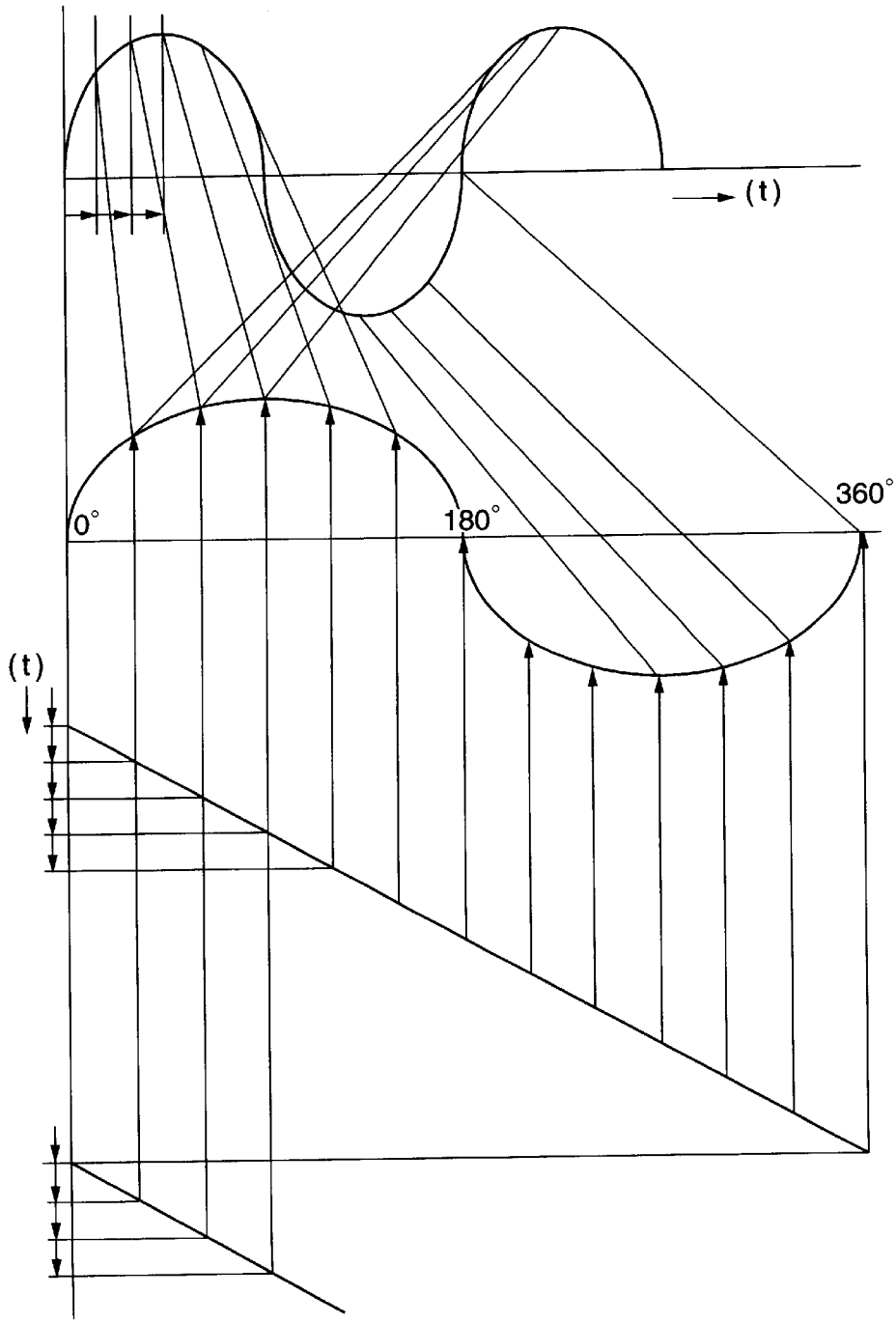
FIG. 4 is a diagram showing a relationship between the input sound signal stored in the ring memory and a read-out sound signal read from the ring memory according to the preferred embodiment of the present invention.

As described above, since an interval from the peak P to the return point F of the sawtooth wave is set to one period of the input sound signal, even at a read address having passed the peak P and increasing again from the return point F. the input sound signal is read from the ring memory 1 with a constant phase difference. Specifically, although data at an address (Rn+2) should be continuously read passing the peak P, data at an address (Rn+2) which is 360° prior in phase is actually read from the ring memory 1. This does not cause any discontinuity of a read-out sound signal read from the ring memory 1 because of a property that adjacent waveforms of the input sound signal are approximately the same with each other. FIG. 4 is a diagram showing a relationship between the input sound signal written into or stored in the ring memory 1 and the read-out sound signal read from the ring memory 1 in the foregoing pitch control technique. In FIG. 4, an intermediate part shows the input sound signal stored in the ring memory 1, while an upper part shows the read-out sound signal. Thus, in this figure, the read-out sound signal has the pitch higher than that of the input sound signal. It is also seen from the figure that the read-out sound signal has no discontinuity in its waveform. As described before, an interval from the peak P to the return point F can be set to a value which is integer (1, 2 3, . . . ) times a period of the input sound signal. This is because the input sound signal is read from the ring memory 1 with a constant phase difference if the interval is set to such an integer-times value, resulting in the same effect.

According to the foregoing preferred embodiment of the present invention, the simpler structure can be provided as compared with the foregoing conventional pitch shifting techniques, and further a pitch-shifted sound free of the foregoing conventional adverse effect to the tone quality can be produced.

While the present invention has been described in terms of the preferred embodiment, the invention is not to be limited thereto, but can be embodied in various ways without departing from the principle of the invention as defined in the appended claims.

What is claimed is:

1. A pitch shifting apparatus comprising:

a memory for storing an input sound signal having a pitch;

a period extracting means for extracting a period of the input sound signal; and an address designating means for producing a sawtooth wave having an amplitude set to a value which is integer times said extracted period and for designating a read address based on said sawtooth wave, wherein the input sound signal is read from said memory using the read address designated by said address designating means for generating a read-out sound signal where the pitch is shifted.

2. The pitch shifting apparatus according to claim 1, wherein said period extracting means counts one wavelength of the input sound signal with a sampling period to derive a counted value corresponding to the period of the input sound signal, and said address designating means sets the amplitude of said sawtooth wave to a value which is integer times said counted value.

3. A pitch shifting method comprising the steps of:

storing an input sound signal having a pitch;

extracting a period of the input sound signal;

producing a sawtooth wave having an amplitude set to a value which is integer times said extracted period;

designating a read address based on said sawtooth wave; and reading the input sound signal from said memory using said read address for generating a read-out sound signal where the pitch is shifted.

4. The pitch shifting method according to claim 3, wherein the step of extracting the period of the input sound signal comprises counting one wavelength of the input sound signal with a sampling period to derive a counted value corresponding to the period of the input sound signal, and the step of producing said sawtooth wave comprises setting the amplitude of said sawtooth wave to a value which is integer times said counted value.

* * * * *